US011060236B2

(12) United States Patent
Djerekarov et al.

(10) Patent No.: US 11,060,236 B2
(45) Date of Patent: Jul. 13, 2021

(54) DRYER APPLIANCE AND METHOD OF OPERATING THE SAME BASED ON THE RELATIVE HUMIDITY OF DRUM EXIT AIR

(71) Applicant: Haier US Appliance Solutions, Inc., Wilmington, DE (US)

(72) Inventors: Jivko Ognianov Djerekarov, Louisville, KY (US); David Scott Dunn, Louisville, KY (US); Brian Michael Schork, Louisville, KY (US); Katherine Ashley De Arazoza, Miami, FL (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 23 days.

(21) Appl. No.: 16/592,076

(22) Filed: Oct. 3, 2019

(65) Prior Publication Data

US 2021/0102333 A1 Apr. 8, 2021

(51) Int. Cl.
*D06F 58/30* (2020.01)
*D06F 58/20* (2006.01)
(Continued)

(52) U.S. Cl.
CPC ..... *D06F 58/30* (2020.02); *D06F 58/206* (2013.01); *D06F 58/38* (2020.02);
(Continued)

(58) Field of Classification Search
CPC ..... D06F 58/30; D06F 58/206; D06F 58/38; D06F 2103/08; D06F 2103/50; D06F 2103/36; D06F 2105/26; D06F 2105/24
(Continued)

(56) References Cited

U.S. PATENT DOCUMENTS 6,098,310 A * 8/2000 Chen ..... D06F 58/02 34/475
7,228,647 B2 * 6/2007 Hong ..... D06F 58/24 34/596
(Continued)

FOREIGN PATENT DOCUMENTS

CA 2887462 A1 * 10/2015 ..... D06F 58/30
DE 102014223799 A1 5/2016
(Continued)

*Primary Examiner* — Stephen M Gravini
(74) *Attorney, Agent, or Firm* — Dority & Manning, P.A.

(57) ABSTRACT

A dryer appliance and a method of operating the same are provided. In one aspect, the dryer appliance includes a drum rotatably mounted within a cabinet. The drum defines a chamber that is in fluid communication with a conditioning system of the dryer appliance. The conditioning system heats air circulating therethrough. A variable speed blower fan is provided to circulate air between the conditioning system and the chamber. A sensor is positioned at or proximate a drum exit of the drum. A controller of the dryer appliance receives an input indicative of the relative humidity of the air at the drum exit. Based on the received input, the controller determines a control command. The control command can be routed to a blower fan motor operable to drive the blower fan. The blower fan motor receives the control command and adjusts a flow rate of the air exiting the drum exit.

15 Claims, 6 Drawing Sheets

(51) Int. Cl.

| | |
|---|---|
| ***D06F 58/38*** | (2020.01) |
| ***D06F 103/08*** | (2020.01) |
| ***D06F 103/36*** | (2020.01) |
| ***D06F 103/50*** | (2020.01) |
| ***D06F 105/24*** | (2020.01) |
| ***D06F 105/26*** | (2020.01) |

(52) U.S. Cl.
CPC ..... *D06F 2103/08* (2020.02); *D06F 2103/36* (2020.02); *D06F 2103/50* (2020.02); *D06F 2105/24* (2020.02); *D06F 2105/26* (2020.02)

(58) Field of Classification Search
USPC ..... 34/491, 595–610
See application file for complete search history.

(56) References Cited

U.S. PATENT DOCUMENTS

| | | | | |
|---|---|---|---|---|
| 7,975,401 | B2 * | 7/2011 | Beaulac | D06F 58/30 34/601 |
| 8,286,369 | B2 * | 10/2012 | Dittmer | D06F 58/30 34/528 |
| 8,469,043 | B2 * | 6/2013 | Tolf | A47L 15/488 134/95.3 |
| 8,549,770 | B2 * | 10/2013 | Bellinger | D06F 58/30 34/486 |
| 8,661,706 | B2 * | 3/2014 | Bellinger | D06F 58/30 34/486 |
| 8,863,400 | B2 * | 10/2014 | Ahn | D06F 58/02 34/74 |
| 9,091,014 | B2 * | 7/2015 | Park | D06F 58/203 |
| 9,510,728 | B2 * | 12/2016 | Tuller | A47L 15/488 |
| 10,087,570 | B2 * | 10/2018 | Santillan Galvan | D06F 58/30 |
| 10,184,208 | B2 * | 1/2019 | Rizzi | D06F 58/02 |
| 10,472,761 | B2 * | 11/2019 | Pistochini | D06F 58/30 |
| 2005/0066538 | A1 * | 3/2005 | Goldberg | D06F 25/00 34/218 |
| 2007/0151311 | A1 * | 7/2007 | McAllister | D06F 58/10 68/3 R |
| 2011/0041562 | A1 * | 2/2011 | Balinski | D06F 35/008 68/20 |
| 2014/0020260 | A1 | 1/2014 | Carow et al. | |
| 2015/0059200 | A1 * | 3/2015 | Prajescu | D06F 58/30 34/282 |
| 2016/0076193 | A1 * | 3/2016 | Santillan Galvan | G05B 15/02 700/275 |
| 2018/0057997 | A1 | 3/2018 | Wu | |
| 2020/0087845 | A1 * | 3/2020 | Dunn | D06F 58/30 |

FOREIGN PATENT DOCUMENTS

| | | | | |
|---|---|---|---|---|
| EP | 2811058 | A1 | 12/2014 | |
| EP | 2343412 | B1 * | 8/2016 | D06F 58/203 |
| KR | 20110080620 | A * | 7/2011 | D06F 58/30 |

* cited by examiner

DRYER APPLIANCE AND METHOD OF OPERATING THE SAME BASED ON THE RELATIVE HUMIDITY OF DRUM EXIT AIR

FIELD OF THE INVENTION

The present subject matter relates generally to dryer appliances, and more particularly to operating dryer appliances based on the relative humidity of drum exit air.

BACKGROUND OF THE INVENTION

A conventional dryer appliance for drying articles typically includes a cabinet having a rotating drum for tumbling clothes and laundry articles therein. One or more heating elements heat air prior to the air entering the drum, and the warm air is circulated through the drum as the clothes are tumbled to remove moisture from laundry articles in the drum. Gas or electric heating elements may be used to heat the air that is circulated through the drum. Ambient air from outside the appliance is drawn into the cabinet and passed through the heater before being fed to the drum. Moisture from the clothing is transferred to the air passing through the drum. Typically, this moisture laden air is then transported away from the dryer by, for example, a duct leading outside of the structure or room where the dryer is placed. The exhausted air removes moisture from the dryer and the clothes are dried as the process is continued by drawing in more ambient air. Unfortunately, for the conventional dryer described above, the exhausted air is still relatively warm while the ambient air drawn into the dryer must be heated. This process is relatively inefficient because heat energy in the exhausted air is lost and additional energy must be provided to heat more ambient air.

One alternative to a conventional dryer as described above is a heat pump dryer. A heat pump dryer uses a refrigerant cycle to both provide hot air to the dryer and to condense water vapor in air coming from the dryer. Since the moisture content in the air from the dryer is reduced by condensation over the evaporator, this same air can be reheated again using the condenser and then passed through the dryer again to remove more moisture. Moreover, since the air is recycled through the dryer in a closed loop rather than being ejected to the environment, the heat pump dryer can be more efficient to operate than the traditional dryer described above. In addition, the heating source provided by the sealed refrigerant system of a heat pump dryer can be more efficient than a gas or electric heater implemented in the conventional dryer.

Current heat pump dryer appliances typically use a fan to move air through the closed loop system to dry the articles within the drum. However, due to different load-to-load sizes and fabric compositions, heat pump dryer appliances are not always operated at optimal conditions to maximize moisture extraction and cycle efficiency. One way to improve the psychrometric efficiency of the dryer appliance is to vary the sealed system capacity by using a variable speed compressor. However, such a method requires complex cycle point mapping for compressor speed changes and may not be cost effective. In addition, closed-loop system heat pump dryer appliances typically operate at relatively low temperatures compared to conventional vented dryer appliances and lose moisture removal effectiveness towards the end of a drying cycle. The current state of the art presents no effective solution to this challenge.

Accordingly, a dryer appliance and methods of operating the same that address one or more of the challenges noted above would be advantageous.

BRIEF DESCRIPTION OF THE INVENTION

Aspects and advantages of the invention will be set forth in part in the following description, or may be obvious from the description, or may be learned through practice of the invention.

In one aspect, a dryer appliance is provided. The dryer appliance includes a cabinet and a drum rotatably mounted within the cabinet, the drum defining a chamber for the receipt of articles for drying, the drum defining a drum exit and a drum inlet to the chamber. The dryer appliance also includes a conditioning system configured to heat and remove moisture from air flowing therethrough. The dryer appliance further includes a duct system for providing fluid communication between the drum exit and the conditioning system and between the conditioning system and the drum inlet, the duct system, the conditioning system, and the drum defining a process air flowpath. Moreover, the dryer appliance includes a blower fan operable to move air through the process air flowpath and a sensor. The dryer appliance also includes a controller communicatively coupled with the blower fan and the sensor. The controller is configured to: receive, from the sensor, an input indicative of a relative humidity of moisture-laden air exiting the chamber through the drum exit; determine one or more control commands based at least in part on the received input indicative of the relative humidity of moisture-laden air exiting the chamber through the drum exit; and cause the blower fan to adjust a volumetric flow rate of moisture-laden air exiting the chamber through the drum exit based at least in part on the determined one or more control commands.

In another aspect, a method of operating a dryer appliance is provided. The method includes receiving, by a controller of the dryer appliance, an input indicative of a relative humidity of moisture-laden air exiting a chamber defined by a drum of the dryer appliance. The method also includes determining, by the controller, one or more control commands based at least in part on the received input indicative of the relative humidity of moisture-laden air exiting the chamber of the drum. Further, the method includes causing a blower fan to adjust a volumetric flow rate of moisture-laden air exiting the chamber of the drum based at least in part on the determined one or more control commands.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
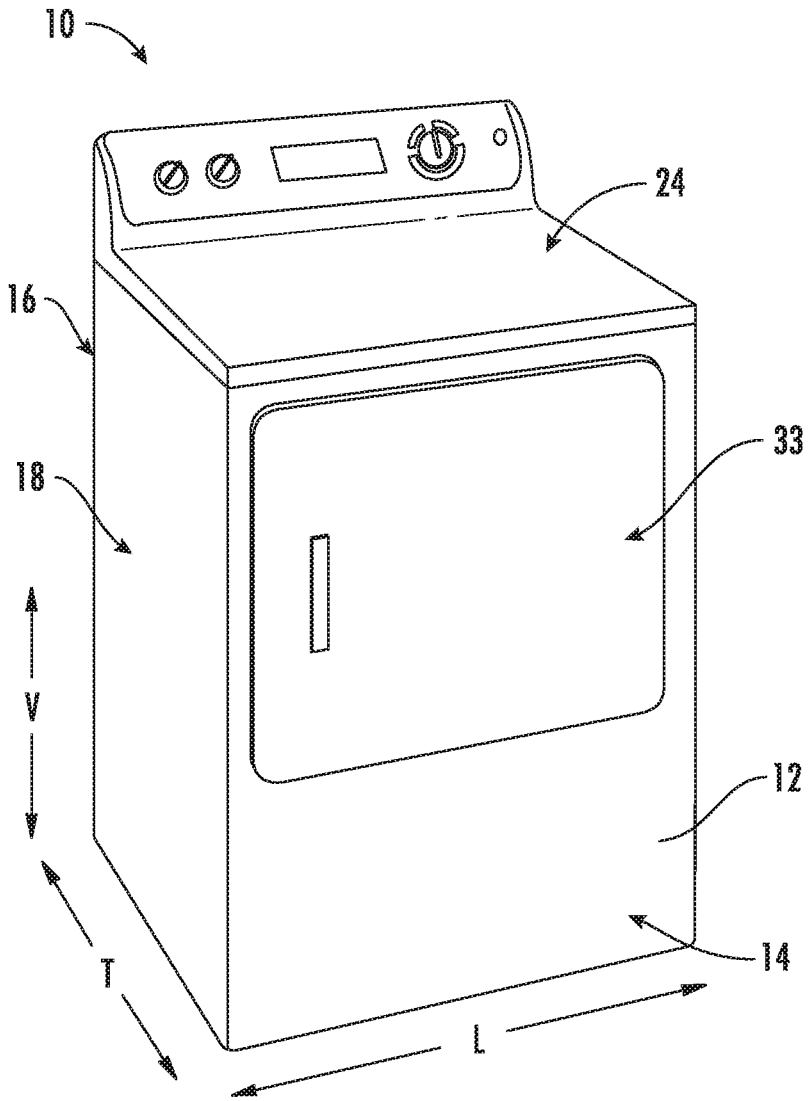
FIG. 1 provides a perspective view of a dryer appliance in accordance with exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
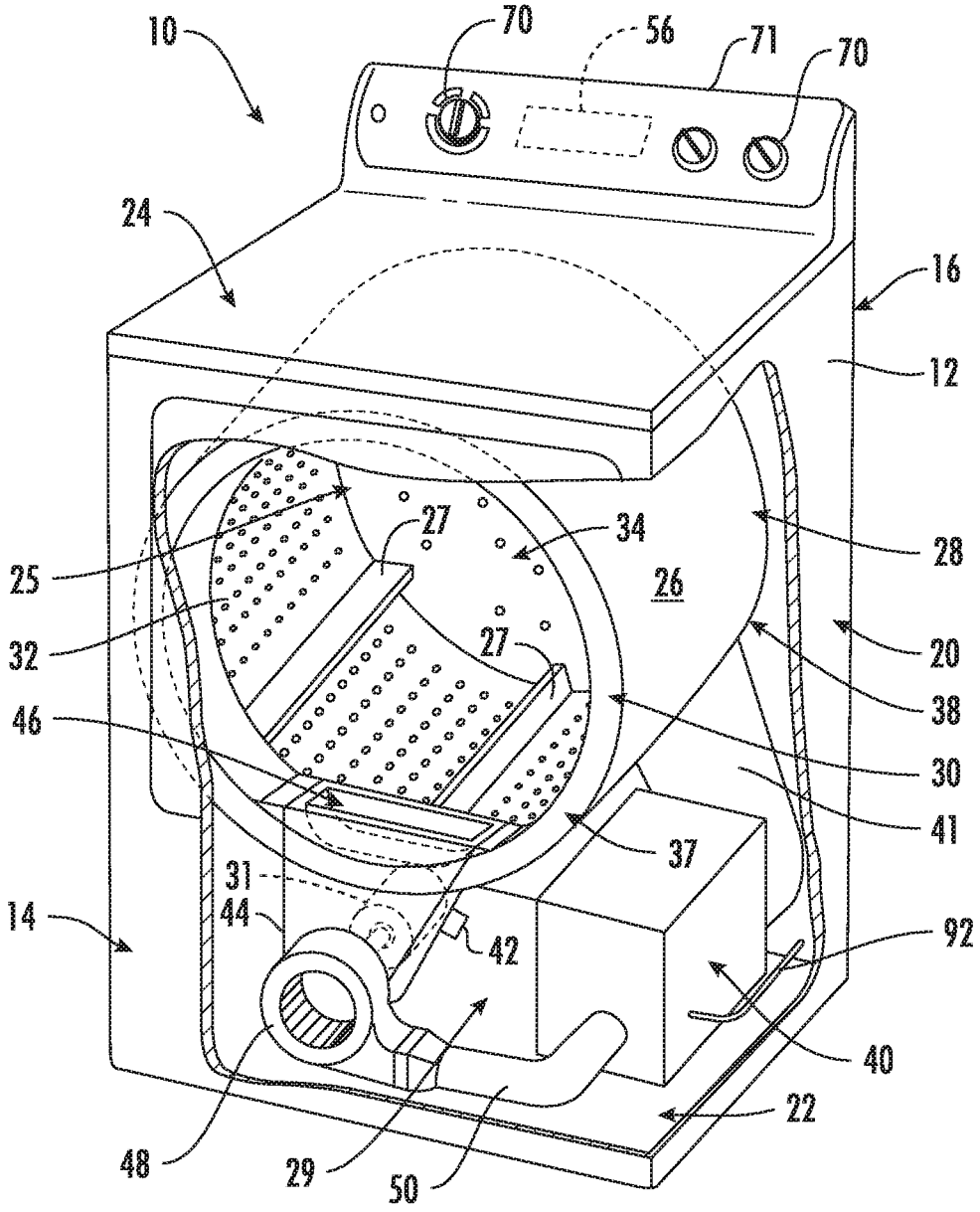
FIG. 2 provides a perspective view of the example dryer appliance of FIG. 1 with portions of a cabinet of the dryer appliance removed to reveal certain components of the dryer appliance.

FIGS. 1 and 2 provide perspective views of a dryer appliance 10 according to exemplary embodiments of the present disclosure. Particularly, FIG. 1 provides a perspective view of dryer appliance 10 and FIG. 2 provides another perspective view of dryer appliance 10 with a portion of a housing or cabinet 12 of dryer appliance 10 removed in order to show certain components of dryer appliance 10. As depicted, dryer appliance 10 defines a vertical direction V, a lateral direction L, and a transverse direction T, each of which is mutually perpendicular such that an orthogonal coordinate system is defined. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well. For instance, in some embodiments, dryer appliance 10 can be a combination washing machine/dryer appliance.

Cabinet 12 includes a front panel 14, a rear panel 16, a pair of side panels 18 and 20 spaced apart from each other by front and rear panels 14 and 16 along the lateral direction L, a bottom panel 22, and a top cover 24. Cabinet 12 defines an interior volume 29. A container or drum 26 is mounted for rotation about a substantially horizontal axis within the interior volume 29 of cabinet 12. Drum 26 defines a chamber 25 for receipt of articles for tumbling and/or drying. Drum 26 extends between a front portion 37 and a back portion 38, e.g., along the transverse direction T. Drum 26 also includes a back or rear wall 34, e.g., at back portion 38 of drum 26. A supply duct 41 may be mounted to rear wall 34. Supply duct 41 receives heated air that has been heated by a conditioning system 40 and provides the heated air to drum 26 via one or more holes defined by rear wall 34.

As used herein, the terms "clothing" or "articles" includes but need not be limited to fabrics, textiles, garments, linens, papers, or other items from which the extraction of moisture is desirable. Furthermore, the term "load" or "laundry load" refers to the combination of clothing that may be washed together in a washing machine or dried together in a dryer appliance 10 (e.g., clothes dryer) and may include a mixture of different or similar articles of clothing of different or similar types and kinds of fabrics, textiles, garments and linens within a particular laundering process.

In some embodiments, a motor 31 is provided to rotate drum 26 about the horizontal axis, e.g., via a pulley and a belt (not pictured). Drum 26 is generally cylindrical in shape. Drum 26 has an outer cylindrical wall 28 and a front flange or wall 30 that defines an opening 32 of drum 26, e.g., at front portion 37 of drum 26, for loading and unloading of articles into and out of chamber 25 of drum 26. Drum 26 includes a plurality of lifters or baffles 27 that extend into chamber 25 to lift articles therein and then allow such articles to tumble back to a bottom of drum 26 as drum 26 rotates. Baffles 27 may be mounted to drum 26 such that baffles 27 rotate with drum 26 during operation of dryer appliance 10.

Rear wall 34 of drum 26 is rotatably supported within cabinet 12 by a suitable bearing. Rear wall 34 can be fixed or can be rotatable. Rear wall 34 may include, for instance, a plurality of holes that receive hot air that has been heated by a conditioning system 40, e.g., a heat pump or refrigerant-based conditioning system as will be described further below. Moisture laden, heated air is drawn from drum 26 by an air handler, such as a blower fan 48, which generates a negative air pressure within drum 26. The moisture laden heated air passes through a duct 44 enclosing screen filter 46, which traps lint particles. As the air passes from blower fan 48, it enters a duct 50 and then is passed into conditioning system 40. In some embodiments, the conditioning system 40 may be or include an electric heating element, e.g., a resistive heating element, or a gas-powered heating element, e.g., a gas burner. For this embodiment, dryer appliance 10 is a heat pump dryer appliance and thus conditioning system 40 may be or include a heat pump including a sealed refrigerant circuit, as described in more detail below with reference to FIG. 3. Heated air (with a lower moisture content than was received from drum 26), exits conditioning system 40 and returns to drum 26 by duct 41. After the clothing articles have been dried, they are removed from the drum 26 via opening 32. A door 33 provides for closing or accessing drum 26 through opening 32.

In some embodiments, one or more selector inputs 70, such as knobs, buttons, touchscreen interfaces, etc., may be provided or mounted on a cabinet 12 (e.g., on a backsplash 71) and are communicatively coupled with (e.g., electrically coupled or coupled through a wireless network band) a processing device or controller 56. Controller 56 may also be communicatively coupled with various operational components of dryer appliance 10, such as motor 31, blower 48, and/or components of conditioning system 40. In turn, signals generated in controller 56 direct operation of motor 31, blower 48, or conditioning system 40 in response user inputs to selector inputs 70. As used herein, "processing device" or "controller" may refer to one or more microprocessors, microcontroller, ASICS, or semiconductor devices and is not restricted necessarily to a single element. The controller 56 may be programmed to operate dryer appliance 10 by executing instructions stored in memory (e.g., non-transitory media). The controller 56 may include, or be associated with, one or more memory elements such as RAM, ROM, or electrically erasable, programmable read only memory (EEPROM). For example, the instructions may be software or any set of instructions that when executed by the processing device, cause the processing device to perform operations. It should be noted that controller 56 as disclosed herein is capable of and may be operable to perform any methods or associated method steps as disclosed herein. For example, in some embodiments, methods disclosed herein may be embodied in programming instructions stored in the memory and executed by the controller 56.

As further shown in FIG. 2, dryer appliance 10 can include one or more sensors. For this embodiment, dryer appliance 10 includes a sensor 42 positioned at or proximate an exit of drum 26. Sensor 42 is operatively configured to output signals indicative of a relative humidity of the moisture-laden heated air at the exit of drum 26. Thus, in some embodiments, sensor 42 is a humidity sensor. Sensor 42 is communicatively coupled with controller 56, e.g., via one or more wired or wireless communication links. Accordingly, the signals indicative of the relative humidity of the moisture-laden heated air exiting drum 26 output by sensor 42 can be sent to and received as inputs by controller 56 for processing. As will be explained in detail herein, controller 56 can determine control commands based at least in part on the signals received from sensor 42. The determined control commands can be outputted by controller 56 and routed to one or more operational components of dryer appliance 10. For example, one or more control commands output by controller 56 can cause blower fan 48 to vary the volumetric flow rate of the air flowing through drum 26, or more particularly, the flow rate of the air exiting drum 26. In this way, faster and more efficient drying cycles can be performed and the final moisture content (FMC) at the end of a drying cycle can be lowered, among other benefits.

Figure 3:
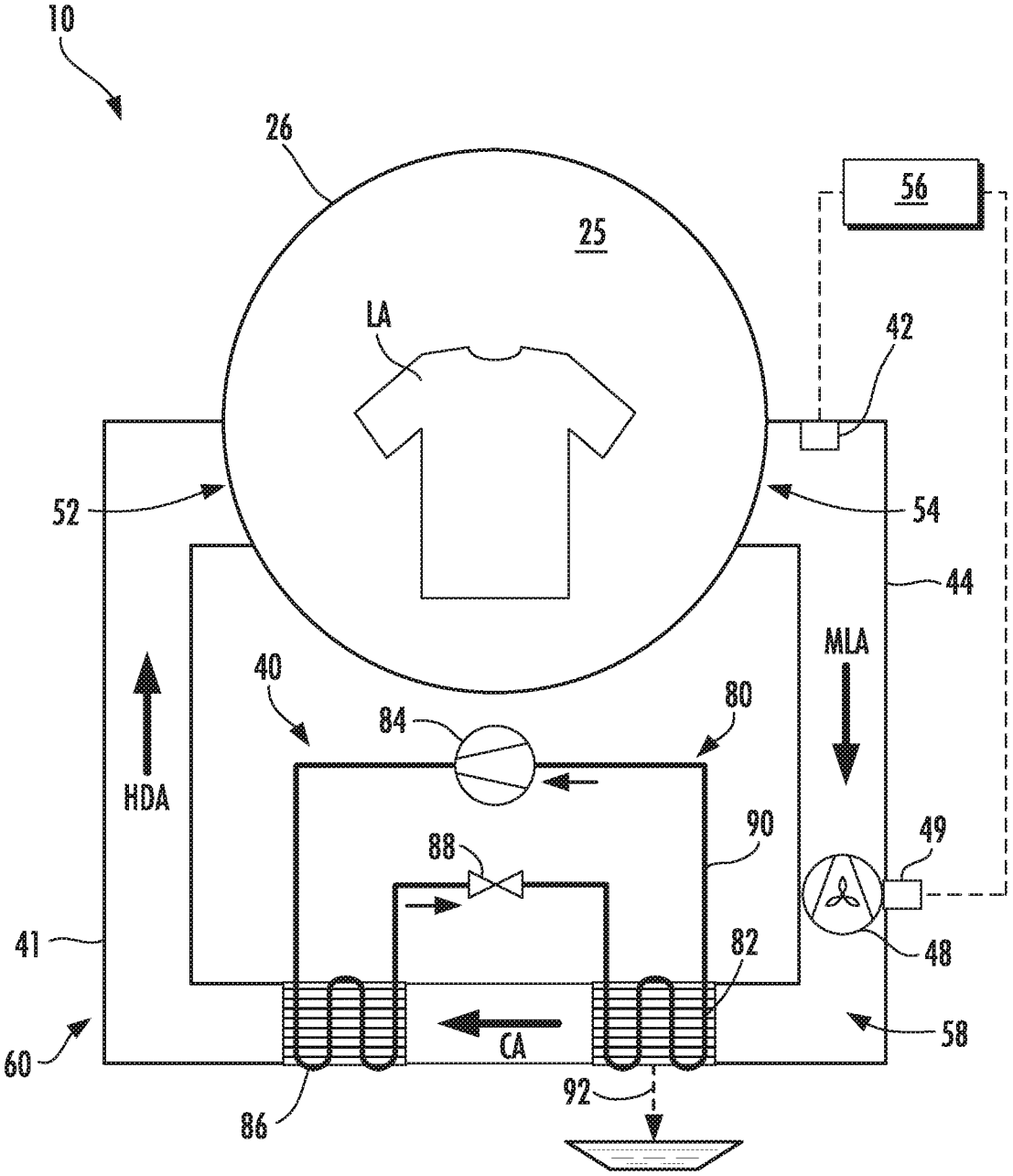
FIG. 3 provides a schematic diagram of an exemplary heat pump dryer appliance and a conditioning system thereof in accordance with exemplary embodiments of the present disclosure.

FIG. 3 provides a schematic view of dryer appliance 10 and depicts conditioning system 40 in more detail. For this embodiment, dryer appliance 10 is a heat pump dryer appliance and thus conditioning system 40 includes a sealed system 80. Sealed system 80 includes various operational components, which can be encased or located within a machinery compartment of dryer appliance 10. Generally, the operational components are operable to execute a vapor compression cycle for heating air passing through conditioning system 40. The operational components of sealed system 80 include an evaporator 82, a compressor 84, a condenser 86, and one or more expansion devices 88 connected in series along a refrigerant circuit or line 90. Refrigerant line 90 is charged with a refrigerant. Sealed system 80 depicted in FIG. 3 is provided by way of example only. Thus, it is within the scope of the present subject matter for other configurations of the sealed system to be used as well. As will be understood by those skilled in the art, sealed system 80 may include additional components, e.g., at least one additional evaporator, compressor, expansion device, and/or condenser. As an example, sealed system 80 may include two (2) evaporators.

In performing a drying and/or tumbling cycle, one or more laundry articles LA may be placed within the chamber 25 of drum 26. Hot dry air HDA is supplied to chamber 25 via duct 41. The hot dry air HDA enters chamber 25 of drum via a drum inlet 52 defined by drum 26, e.g., the plurality of holes defined in rear wall 34 of drum 26 as shown in FIG. 2. The hot dry air HDA provided to chamber 25 causes moisture within laundry articles LA to evaporate. Accordingly, the air within chamber 25 increases in water content and exits chamber 25 as warm moisture laden air MLA. The warm moisture laden air MLA exits chamber 25 through a drum exit 54 defined by drum 26 and flows into duct 44. As depicted in FIG. 3, sensor 42 can be positioned at or proximate drum exit 54. As will be explained further below, sensor 42 can output signals indicative of the relative humidity of the moisture laden air MLA exiting chamber 25 of drum 26 through drum exit 54. The sensor outputs can then be used by controller 56 (FIG. 2) to control dryer appliance 10.

After exiting chamber 25 of drum 26, the warm moisture laden air MLA flows downstream to conditioning system 40. Blower fan 48 moves the warm moisture laden air MLA, as well as the air more generally, through a process air flowpath 58 defined by drum 26, conditioning system 40, and the duct system 60. Thus, generally, blower fan 48 is operable to move air through or along the process air flowpath 58. Duct system 60 includes all ducts that provide fluid communication (e.g., airflow communication) between drum exit 54 and conditioning system 40 and between conditioning system 40 and drum inlet 52. Although blower fan 48 is shown positioned between drum 26 and conditioning system 40 along duct 44, it will be appreciated that blower fan 48 can be positioned in other suitable positions or locations along duct system 60.

As further depicted in FIG. 3, the warm moisture laden air MLA flows into or across evaporator 82 of the conditioning system 40. As the moisture laden air MLA passes across evaporator 82, the temperature of the air is reduced through heat exchange with refrigerant that is vaporized within, for example, coils or tubing of evaporator 82. This vaporization process absorbs both the sensible and the latent heat from the moisture laden air MLA—thereby reducing its temperature. As a result, moisture in the air is condensed and such condensate may be drained from conditioning system 40, e.g., using a drain line 92, which is also depicted in FIG. 2.

Air passing over evaporator 82 becomes cooler than when it exited drum 26 at drum exit 54. As shown, cool air CA (cool relative to hot dry air HDA and moisture laden air MLA) flowing downstream of evaporator 82 is subsequently caused to flow across condenser 86, e.g., across coils or tubing thereof, which condenses refrigerant therein. The refrigerant enters condenser 86 in a gaseous state at a relatively high temperature compared to the cool air CA from evaporator 82. As a result, heat energy is transferred to the cool air CA at the condenser 86, thereby elevating its temperature and providing warm dry air HDA for resupply to drum 26 of dryer appliance 10. The warm dry air HDA passes over and around laundry articles LA within the chamber 25 of the drum 26, such that warm moisture laden air MLA is generated, as mentioned above. Because the air is recycled through drum 26 and conditioning system 40, dryer appliance 10 can have a much greater efficiency than traditional clothes dryers where all of the warm, moisture laden air MLA is exhausted to the environment.

With respect to sealed system 80, compressor 84 pressurizes refrigerant (i.e., increases the pressure of the refrigerant) passing therethrough and generally motivates refrigerant through the sealed refrigerant circuit or refrigerant line 90 of conditioning system 40. Compressor 84 may be communicatively coupled with controller 56 (communication lines not shown in FIG. 3). Refrigerant is supplied from the evaporator 82 to compressor 84 in a low pressure gas phase. The pressurization of the refrigerant within compressor 84 increases the temperature of the refrigerant. The compressed refrigerant is fed from compressor 84 to condenser 86 through refrigerant line 90. As the relatively cool air CA from evaporator 82 flows across condenser 86, the refrigerant is cooled and its temperature is lowered as heat is transferred to the air for supply to chamber 25 of drum 26.

Upon exiting condenser 86, the refrigerant is fed through refrigerant line 90 to expansion device 88. Although only one expansion device 88 is shown, such is by way of example only. It is understood that multiple such devices may be used. In the illustrated example, expansion device 88 is an electronic expansion valve, although a thermal expansion valve or any other suitable expansion device can be used. In additional embodiments, any other suitable expansion device, such as a capillary tube, may be used as well. Expansion device 88 lowers the pressure of the refrigerant and controls the amount of refrigerant that is allowed to enter the evaporator 82. Importantly, the flow of liquid refrigerant into evaporator 82 is limited by expansion device 88 in order to keep the pressure low and allow expansion of the refrigerant back into the gas phase in evaporator 82. The evaporation of the refrigerant in evaporator 82 converts the refrigerant from its liquid-dominated phase to a gas phase while cooling and drying the moisture laden air MLA received from chamber 25 of drum 26. The process is repeated as air is circulated along process air flowpath 58 while the refrigerant is cycled through sealed system 80, as described above.

Although dryer appliance 10 is depicted and described herein as a heat pump dryer appliance, the inventive aspects of the present disclosure can apply to other types of closed loop airflow circuit dryer appliances. For instance, in other embodiments, dryer appliance 10 can be a condenser dryer that utilizes an air-to-air heat exchanger instead of evaporator 82 and/or an electric heater may be provided instead of condenser 86. In yet other embodiments, dryer appliance 10 can be a spray tower dryer appliance that utilizes a water-to-air heat exchanger instead of utilizing a sealed refrigerant. Further, in some embodiments, dryer appliance 10 can be a combination washer/dryer appliance having a closed loop airflow circuit along which process air may flow for drying operations.

As noted previously, conventional dryer appliances do not always run at optimal conditions to maximize moisture extraction and cycle efficiency due to different load sizes and fabric composition of articles placed within the drum of the dryer appliance. In accordance with the inventive aspects of the present disclosure, a dryer appliance is provided that utilizes sensor outputs indicative of the relative humidity of the air exiting the drum to control the blower fan speed of the blower fan. By varying the blower fan speed of the blower fan, the volumetric flow rate of the moisture laden air exiting the drum can be controlled, and thus, the ratio between the relative humidity at the drum inlet and the drum outlet can be optimized. In this way, optimal moisture extraction and efficiency can be achieved. Furthermore, varying the volumetric flow rate of the moisture laden air exiting the drum allows for indirect control of the relative humidity of the hot dry air entering the drum through the drum inlet, which may lower the final moisture content (FMC) toward the end of a drying cycle.

As depicted in FIG. 3, controller 56 is communicatively coupled with the blower fan 48 and sensor 42. More particularly, controller 56 is communicatively coupled with a blower fan motor 49 that is operable to drive blower fan 48. Blower fan motor 49 can be adjusted to a number of different settings, and consequently, blower fan 48 is adjustable between a plurality of speed settings. For instance, blower fan 48 can be adjustable between a first fan speed (the lowest fan speed), a second fan speed, a third fan speed, and a fourth fan speed (the highest fan speed). In other embodiments, blower fan 48 can be adjustable between more or less than four (4) blower fan speeds. Accordingly, blower fan 48 is a variable speed blower fan.

During operation of dryer appliance 10 in a drying cycle, controller 56 is configured to receive, from sensor 42, an input indicative of a relative humidity of moisture-laden air MLA exiting chamber 25 of drum 26 through drum exit 54. Controller 56 is further configured to determine one or more control commands based at least in part on the received input indicative of the relative humidity of moisture-laden air MLA exiting chamber 25 of drum 26 through drum exit 54. Once controller 56 determines the one or more control commands, controller 56 is configured to cause blower fan 48 to adjust or maintain a volumetric flow rate of the moisture-laden air MLA exiting chamber 25 through drum exit 54 based at least in part on the determined one or more control commands.

In some embodiments, in determining the one or more control commands based at least in part on the received input indicative of the relative humidity of moisture-laden air MLA exiting chamber 25 of drum 26 through drum exit 54, controller 56 is configured to determine, based on the input received from sensor 42, whether the relative humidity of moisture-laden air MLA exiting chamber 25 through drum exit 54 is within a predetermined operating range, or in this embodiment, a predetermined relative humidity range. An example manner in which controller 56 determines the one or more control commands based at least in part on the received input indicative of the relative humidity of moisture-laden air MLA exiting chamber 25 of drum 26 through drum exit 54 is provided below.

Figure 4:
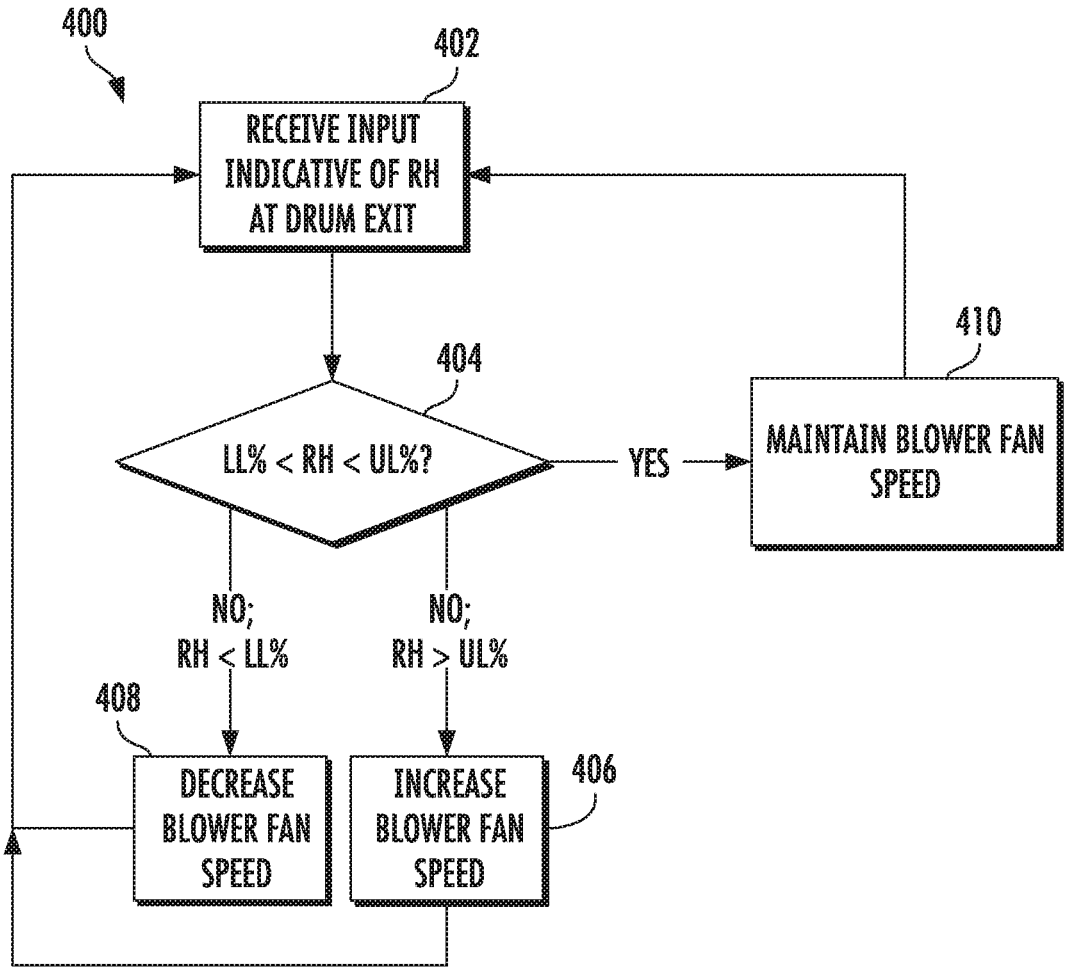
FIG. 4 provides a flow diagram of an example manner in which a controller of dryer appliance may execute control logic in accordance with exemplary embodiments of the present disclosure.

With reference now to FIGS. 3 and 4, FIG. 4 provides a flow diagram of an example method (400) in which controller 56 of dryer appliance 10 may execute control logic in accordance with exemplary embodiments of the present disclosure. Particularly, method (400) depicts an example manner in which controller 56 determines the one or more control commands based at least in part on the received input indicative of the relative humidity of moisture-laden air MLA exiting chamber 25 of drum 26 through drum exit 54.

At (402), during operation of dryer appliance 10 in a drying cycle, the method (400) includes receiving, by controller 56, an input indicative of a relative humidity of moisture-laden air MLA exiting chamber 25 of drum 26 through drum exit 54. The input received by controller 56 can be a sensed output (e.g., an electrical signal) from sensor 42.

At (404), to determine the one or more control commands based at least in part on the received input, controller 56 determines, based on the input received from sensor 42, whether the relative humidity of moisture-laden air MLA exiting chamber 25 through drum exit 54 is within a predetermined operating range, or in this embodiment, a predetermined relative humidity range as noted above. The predetermined operating range has an upper limit UL and a lower limit LL. As one example, the upper limit UL can be 90% relative humidity (RH) and the lower limit LL can be 80% RH. The upper limit UL can be set at any suitable percentage. Likewise, the lower limit LL can be set at any suitable percentage.

When the relative humidity of moisture-laden air MLA exiting chamber 25 through the drum exit 54 is not within the predetermined operating range, e.g., between the lower limit LL and upper limit UL of the predetermined operating range, controller 56 is configured to determine, based on the input received from sensor 42, whether the relative humidity of moisture-laden air MLA exiting chamber 25 through drum exit 54 is greater than the upper limit UL of the predetermined operating range or less than the lower limit LL of the predetermined operating range.

At (406), when controller 56 determines that the relative humidity RH is greater than the upper limit UL at (404), in response, controller 56 causes an increase in a blower fan speed of blower fan 48 based at least in part on the determined one or more control commands. In this way, the volumetric flow rate of moisture-laden air exiting chamber 25 through drum exit 54 is increased and the relative humidity of moisture-laden air MLA exiting chamber 25 through drum exit 54 is decreased. As one example, when controller 56 determines that the relative humidity RH is greater than the upper limit UL, controller 56 can determine one or more control commands (e.g., electrical signals) that cause blower fan motor 49 associated with (e.g., mechanically coupled with) blower fan 48 to increase the blower fan speed of blower fan 48. That is, upon receiving and executing or implementing the one or more control commands, blower fan motor 49 can cause blower fan 48 to increase its blower fan speed. Consequently, the volumetric flow rate of moisture-laden air exiting chamber 25 through drum exit 54 is increased due to the increased blower fan speed and the relative humidity of moisture-laden air MLA exiting chamber 25 through drum exit 54 is decreased due to the decreased residence time that air dwells within chamber 25 to extract moisture. After increasing the blower fan speed at (406), the method (400) can return to (402) where the process is iterated.

At (408), when controller 56 determines that the relative humidity RH is less than the lower limit LL at (404), in response, controller 56 causes a decrease in a blower fan speed of blower fan 48 based at least in part on the determined one or more control commands. In this manner, the volumetric flow rate of moisture-laden air exiting chamber 25 through drum exit 54 is decreased and the relative humidity of moisture-laden air MLA exiting chamber 25 through drum exit 54 is increased. As one example, when controller 56 determines that the relative humidity RH is less than the lower limit LL, controller 56 can determine one or more control commands (e.g., electrical signals) that cause blower fan motor 49 associated with blower fan 48 to decrease the blower fan speed of blower fan 48. That is, upon receiving and executing or implementing the one or more control commands, blower fan motor 49 can cause blower fan 48 to decrease its blower fan speed. Consequently, the volumetric flow rate of moisture-laden air exiting chamber 25 through drum exit 54 is decreased due to the decreased blower fan speed and the relative humidity of moisture-laden air MLA exiting chamber 25 through drum exit 54 is increased due to the increased time that air dwells within chamber 25 to extract moisture. Stated differently, with a decrease in blower fan speed, the air remains in chamber 25 for a longer period of time, and as a result, the air within chamber 25 extracts more moisture assuming the air is not saturated. After decreasing the blower fan speed at (408), the method (400) can return to (402) where the process is iterated.

At (410), when the relative humidity of moisture-laden air MLA exiting chamber 25 of drum 26 through drum exit 54 is within the predetermined operating range as determined by controller 56 at (404), controller 56 causes blower fan 48 to maintain a blower fan speed based at least in part on the determined one or more control commands. Stated another way, if controller 56 determines that the relative humidity of the moisture-laden air MLA exiting chamber 25 is within the predetermined operating range at (404), controller 56 determines that the relative humidity is optimal or near optimal and thus causes blower fan motor 49 to maintain the blower fan speed of blower fan 48. After maintaining the blower fan speed at (410), the method (400) can return to (402) where the process is iterated.

In some embodiments, controller 56 can receive one or more inputs indicative of one or more characteristics of the articles loaded into chamber 25. For instance, in some embodiments, controller 56 can receive an input indicative of a weight of the laundry articles LA loaded into chamber 25. The weight of the laundry articles LA can be an initial weight of the articles prior to commencement of the drying cycle. The weight of the laundry articles LA can be determined in any suitable fashion. By way of example, the weight of the laundry articles LA can be determined based on an electrical power draw by a drum loader of drum 26. In other embodiments, dryer appliance 10 can be a combination washer/dryer. In such embodiments, the weight of the load can be determined during a load sensing process. When the door is not opened between a wash cycle and the drying cycle, controller 56 can utilize the weight measurement determined during the loading sensing process of the wash cycle. The load weight can be determined in other suitable manners as well.

Further, in some embodiments, controller 56 can receive an input indicative of a fabric type of the laundry articles LA loaded into chamber 25. For instance, the input can indicative whether the laundry articles LA are synthetic fabrics, cotton fabrics, etc. Controller 56 can also receive an input indicative of a volume occupied by the laundry articles LA loaded into chamber 25. Such inputs can be sensed during the load sensing process of a wash cycle where drying appliance 10 is a combination washer/dryer or by other suitable manners.

Controller 56 can determine the one or more control commands based at least in part on the received one or more inputs indicative of the one or more characteristics of the articles loaded into chamber 25. For instance, the received one or more inputs indicative of the one or more characteristics of the articles loaded into chamber 25 can be used to determine the upper limit UL (FIG. 4) and the lower limit LL (FIG. 4) of the predetermined operating range. Thus, the blower fan speed can be adjusted, based at least in part, on the received one or more inputs indicative of the one or more characteristics of the articles loaded into chamber 25. Moreover, in some embodiments, the received one or more inputs indicative of the one or more characteristics of the articles loaded into chamber 25 can be used to select blower fan speed settings, and the selected blower fan speed settings can utilized during a drying cycle. For example, the blower fan can have a first blower fan speed setting associated with a first weight range, a first volume range, and a first fabric type of articles loaded into chamber 25, a second blower fan speed setting associated with a second weight range, a second volume range, and a second fabric type of articles loaded into chamber 25, etc. The determined one or more control commands, when implemented by blower fan motor 49, can cause blower fan 48 to operate within a particular selected blower fan speed setting.

As noted, method (400) of FIG. 4 can be an iterative process. In some embodiments, method (400) iterates when dryer appliance 10 is operating in a drying cycle and has reached a steady state condition. A steady state condition is reached when the operational components of conditioning system 40 have stabilized and the hot dry air HDA has reached a predetermined temperature. Method (400) can iterate continuously or at discrete intervals, e.g., every ten seconds (10*s*). In such embodiments, when the heat pump dryer appliance 10 is operating in the steady state condition, controller 56 is configured to iteratively receive, from sensor 42, an input indicative of the relative humidity of moisture-laden air exiting chamber 25 through drum exit 54; determine one or more control commands based at least in part on the received input indicative of the relative humidity of moisture-laden air MLA exiting chamber 25 through drum exit 54; and cause blower fan 48 to adjust a volumetric flow rate of moisture-laden air MLA exiting chamber 25 through drum exit 54 based at least in part on the determined one or more control commands. That is, when dryer appliance 10 is operating in a drying cycle and has reached a steady state condition, controller 56 is configured to perform method (400). By utilizing the sensor outputs indicative of the relative humidity of the air exiting drum 26, controller 56 can control the blower fan speed of blower fan 48 such that optimal moisture extraction rate (MER), specific moisture extraction rate (SMER), and efficiency can be achieved.

Furthermore, closed air system or non-vented heat pump dryers operate at relatively low temperatures compared to vented dryer appliances and lose moisture removal effectiveness towards the end of a drying cycle due to the lack of moisture remaining in the articles. In accordance with the inventive aspects of the present disclosure, the dryer appliance provided herein can vary the volumetric flow rate of the moisture laden air exiting the drum in a controlled manner to ultimately lower the final moisture content (FMC) and/or select a predetermined FMC. As used herein, the FMC is deemed the water remaining in the articles after a drying cycle, or stated mathematically, the weight of the water remaining in the articles divided by the weight of the articles in a dry state, multiplied by one hundred percent (100%).

In some embodiments, with reference to FIG. 3, controller 56 is configured to cause, at a predetermined time with respect to an end (e.g., an end time) of a drying cycle in which the heat pump dryer appliance is operating, a decrease in a blower fan speed of blower fan 48 such that a residence time of air within chamber 25 is increased. In this manner, the air within chamber 25 may extract more moisture than it would otherwise. Specifically, by increasing the dwell or residence time of the air within chamber 25, the relative humidity of the hot dry air HDA entering chamber 25 of drum 26 through drum inlet 52 is decreased thereby increasing the moisture extraction capacity of the hot dry air HDA. At the same time, the relative humidity of the moisture laden air MLA exiting chamber 25 of drum 26 through drum exit 54 is increased as the air has more time to extract moisture from the laundry articles LA. Consequently, the difference between the inlet and outlet relative humidity can be maximized.

In some embodiments, more particularly, controller 56 causes, at the predetermined time with respect to the end of the drying cycle in which the heat pump dryer appliance is operating, the decrease in the blower fan speed of blower fan 48 to decrease at a predetermined interval. The predetermined interval can remain constant or can be varied, e.g., depending on how close in time the current time of the cycle is to the end time of the cycle. Moreover, in some embodiments, the predetermined time and the predetermined interval can be selected based at least in part on inputs received by controller 56 indicative of the relative humidity of the air exiting drum 26. Further, in some embodiments, additionally or alternatively, the predetermined time and the predetermined interval can be selected based at least in part on inputs received by controller 56 indicative of one or more characteristics of the articles within chamber 25, e.g., the load weight, the occupied volume of the articles within chamber 25, and/or the fabric type of the articles.

Figure 5:
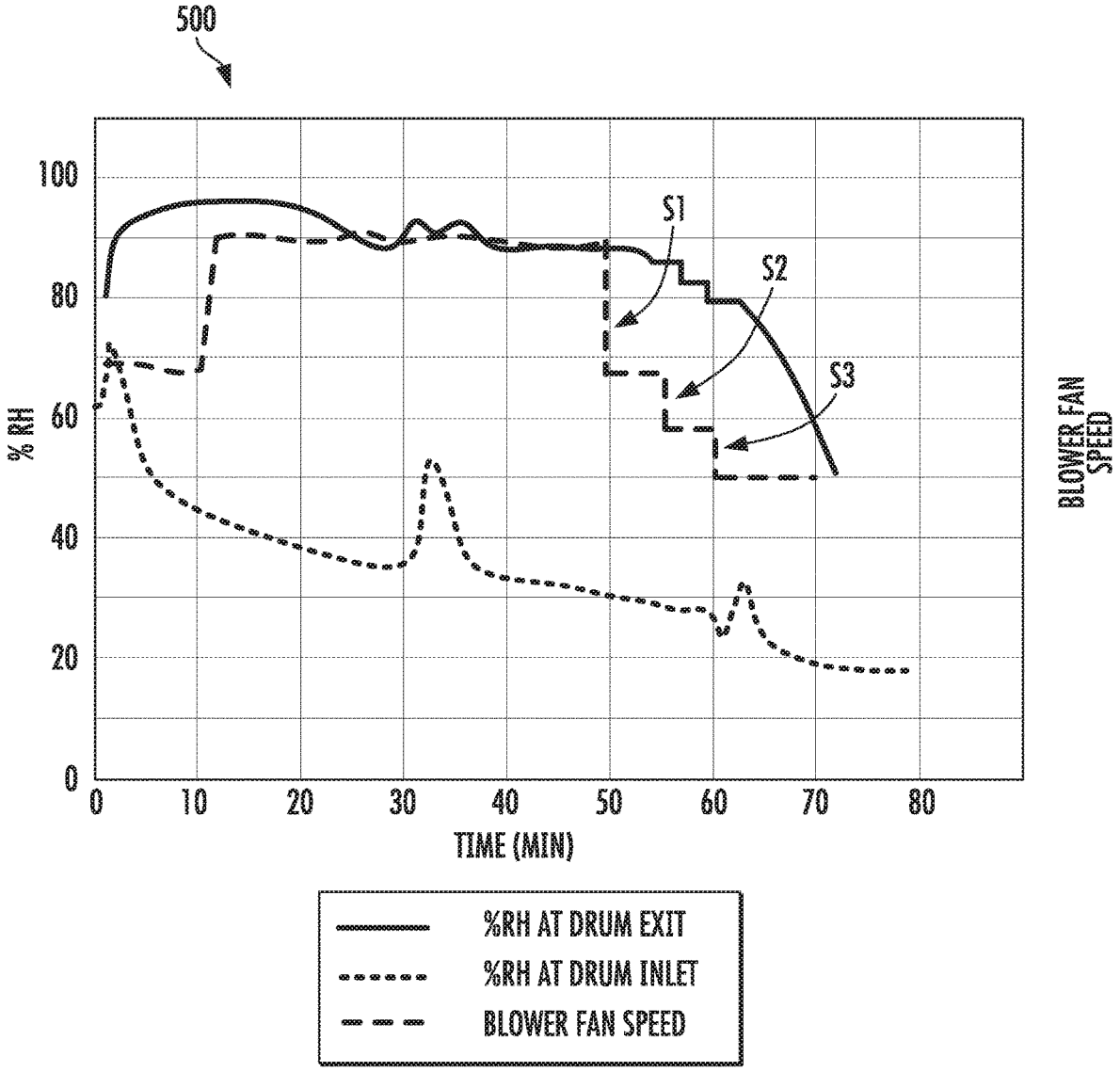
FIG. 5 provides a graph depicting the relative humidity at the drum exit and the drum inlet as well as the blower fan speed as a function of time in accordance with exemplary embodiments of the present disclosure.

By way of example, with reference to FIGS. 3 and 5, FIG. 5 provides a graph 500 depicting the relative humidity of the air at the drum exit and the drum inlet as well as the blower fan speed as a function of time. Further FIG. 5 depicts an example manner in which controller 56 can decrease the blower fan speed of blower fan 48 at the predetermined interval. As shown, at twenty minutes (20 min) from the end of the dry cycle (i.e., the predetermined time in this example), which is at the fifty minute (50 min) mark in the drying cycle, controller 56 causes a decrease in the blower fan speed of blower fan 48. Controller 56 can cause the decrease in blower fan speed by routing a determined control command to blower fan motor 49, and upon executing or implementing the received control command, blower fan motor 49 can reduce the blower fan speed of blower fan 48.

Controller 56 can cause blower fan 48 to decrease speed in a step-wise manner as the drying cycle approaches the end time of the drying cycle as shown in FIG. 5. For instance, at first step decrease 51 shown in the graph 500 of FIG. 5, the blower fan speed can be decreased from a fourth speed (e.g., the fastest speed setting) to a lower, third speed. Then, at a predetermined interval of five minutes (5 min), controller 56 causes blower fan 48 to decrease once again at second step decrease S2. At second step decrease S2, the blower fan speed can be decreased from the third speed to a lower, second speed setting. Continuing with the example, after five minutes (5 min) (i.e., the predetermined interval in this example), controller 56 causes blower fan 48 to decrease once again at a third step decrease S3. At third step decrease S3, the blower fan speed can be decreased from the second speed to a lower, first speed setting (e.g., the slowest speed setting). The fan speed is set to the first speed setting for the remaining ten minutes (10 min) of the drying cycle as shown in FIG. 5.

The manner in which the fan speed of blower fan 48 is decreased in FIG. 5 is provided by way of example only. It will be appreciated that the fan speed of blower fan 48 can be decreased in other suitable manners as well. For instance, in some embodiments, the fan speed of blower fan 48 can be decreased gradually over time. By decreasing the blower fan speed, the air can dwell or reside within chamber 25 for a longer period of time, and thus, the air can extract more moisture and dry the articles faster, particularly toward the end of a drying cycle. Stepping down or more generally decreasing the fan speed toward the end of the cycle allows for indirect control of the relative humidity of the hot dry air entering the drum through the drum inlet, which may lower the final moisture content (FMC) toward the end of the drying cycle. The increased difference in the specific humidity ratio between the entrance and exit of the drum allows for additional moisture extraction, without the need to vary compressor capacity or use additional heaters.

Figure 6:
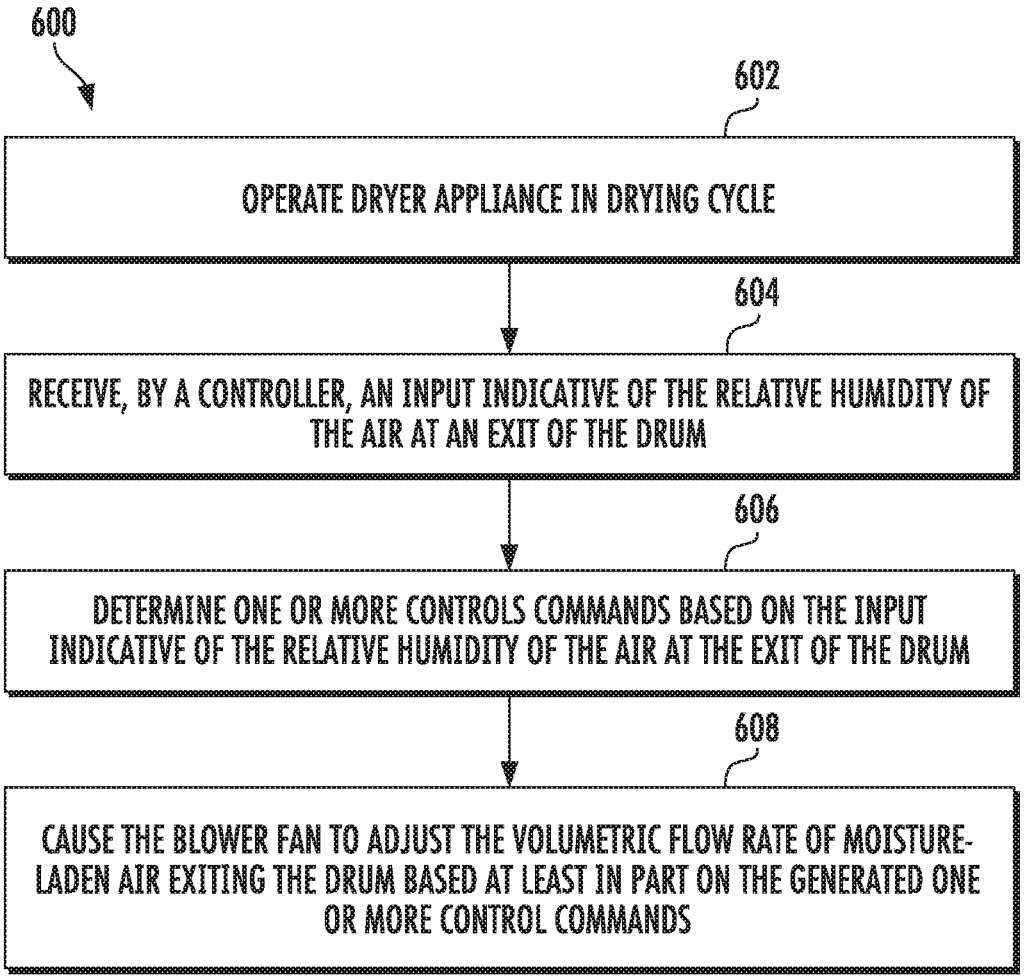
FIG. 6 provides a flow chart of an exemplary method of operating a dryer appliance according to one or more embodiments of the present disclosure.

FIG. 6 provides a flow diagram of an example method (600) of operating a dryer appliance. For instance, the dryer appliance 10 described herein can be operated as set forth in method (600). FIG. 6 depicts steps performed in a particular order for purposes of illustration and discussion. Those of ordinary skill in the art, using the disclosures provided herein, will understand that various steps of any of the methods disclosed herein can be modified in various ways without deviating from the scope of the present disclosure.

At (602), the method (600) includes operating the dryer appliance in a drying cycle. In some embodiments, before proceeding to (604), a controller of the dryer appliance can determine whether the dryer appliance is operating in a steady state condition. A steady state condition is reached when operational components of a conditioning system (e.g., sealed system 80 described herein) have stabilized with respect to temperature. In some implementations, the steady-state condition can be assumed after a predetermined time from commencing the drying cycle. In other exemplary embodiments, the dryer appliance can include one or more temperature sensors that can provide temperature measurements to the controller. Based at least in part on the received temperature measurements, the controller can determine whether the dryer appliance is operating in a steady-state condition. When the heat pump dryer appliance is operating in the steady state condition, the controller is configured to iteratively perform (604), (606), and (608) of method (600).

At (604), the method (600) includes receiving, by a controller of the heat pump dryer appliance, an input indicative of a relative humidity of moisture-laden air exiting a chamber defined by a drum of the heat pump dryer appliance.

At (606), the method (600) includes determining, by the controller, one or more control commands based at least in part on the received input indicative of the relative humidity of moisture-laden air exiting the chamber of the drum.

At (608), the method (600) includes causing a blower fan to adjust a volumetric flow rate of moisture-laden air exiting the chamber of the drum based at least in part on the determined one or more control commands.

In some implementations, determining the one or more control commands based at least in part on the received input indicative of the relative humidity of moisture-laden air exiting the chamber at (606) includes determining, by the controller and based on the received input, whether the relative humidity of moisture-laden air exiting the chamber is within a predetermined operating range. When the relative humidity of moisture-laden air exiting the chamber is not within the predetermined operating range, the method further includes determining, by the controller and based on the received input, whether the relative humidity of moisture-laden air exiting the chamber through the drum exit is greater than an upper limit of the operating range or less than a lower limit of the operating range.

On one hand, when the relative humidity of moisture-laden air exiting the chamber is greater than the upper limit of the operating range as determined at (606), at (608) the controller causes an increase in a blower fan speed of the blower fan based at least in part on the one or more control commands such that the volumetric flow rate of moisture-laden air exiting the chamber is increased and the relative humidity of moisture-laden air exiting the chamber is decreased. On the other hand, when the relative humidity of moisture-laden air exiting the chamber is less than the lower limit of the operating range as determined at (606), at (608) the controller causes a decrease in a blower fan speed of the blower fan based at least in part on the determined one or more control commands such that the volumetric flow rate of moisture-laden air exiting the chamber through the drum exit is decreased and the relative humidity of moisture-laden air exiting the chamber through the drum exit is increased. Furthermore, when the relative humidity of moisture-laden air exiting the chamber is within the predetermined operating range as determined at (606), at (608) the controller causes the blower fan to maintain a blower fan speed based at least in part on the determined one or more control commands.

In some implementations, the method (600) further includes causing, by the controller at a predetermined time with respect to an end of a drying cycle in which the heat pump dryer appliance is operating, a decrease in a blower fan speed of the blower fan such that a relative humidity of hot dry air entering the chamber is decreased. In some further implementations, the controller causes, at the predetermined time with respect to the end of the drying cycle in which the heat pump dryer appliance is operating, the decrease in the blower fan speed of the blower fan to decrease at a predetermined interval. For instance, the controller can cause the blower fan to decrease speed in a step-wise manner as the drying cycle approaches the end time of the drying cycle, e.g., as shown in FIG. 5.

Although specific features of various embodiments may be shown in some drawings and not in others, this is for convenience only. In accordance with the principles of the present disclosure, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance, comprising:

a cabinet;

a drum rotatably mounted within the cabinet, the drum defining a chamber for receipt of articles for drying, the drum defining a drum exit and a drum inlet to the chamber;

a conditioning system;

a duct system for providing fluid communication between the drum exit and the conditioning system and between the conditioning system and the drum inlet, the duct system, the conditioning system, and the drum defining a process air flowpath, the process air flowpath being a closed loop airflow circuit;

a blower fan operable to move air through the process air flowpath;

a sensor;

a controller communicatively coupled with the blower fan and the sensor, the controller configured to:

receive, from the sensor, an input indicative of a relative humidity of moisture-laden air exiting the chamber through the drum exit;

determine one or more control commands based at least in part on the received input indicative of the relative humidity of moisture-laden air exiting the chamber through the drum exit; and cause the blower fan to adjust a volumetric flow rate of moisture-laden air exiting the chamber through the drum exit based at least in part on the determined one or more control commands.

2. The dryer appliance of claim 1, wherein in determining the one or more control commands based at least in part on the received input indicative of the relative humidity of moisture-laden air exiting the chamber through the drum exit, the controller is configured to:

determine, based on the input received from the sensor, whether the relative humidity of moisture-laden air exiting the chamber through the drum exit is within a predetermined operating range.

3. The dryer appliance of claim 2, wherein when the relative humidity of moisture-laden air exiting the chamber through the drum exit is not within the predetermined operating range, the controller is configured to:

determine, based on the input received from the sensor, whether the relative humidity of moisture-laden air exiting the chamber through the drum exit is greater than an upper limit of the predetermined operating range or less than a lower limit of the predetermined operating range.

4. The dryer appliance of claim 3, wherein when the relative humidity of moisture-laden air exiting the chamber through the drum exit is greater than the upper limit of the predetermined operating range, the controller causes an increase in a blower fan speed of the blower fan based at least in part on the determined one or more control commands such that the volumetric flow rate of moisture-laden air exiting the chamber through the drum exit is increased and the relative humidity of moisture-laden air exiting the chamber through the drum exit is decreased.

5. The dryer appliance of claim 3, wherein when the relative humidity of moisture-laden air exiting the chamber through the drum exit is less than the lower limit of the predetermined operating range, the controller causes a decrease in a blower fan speed of the blower fan based at least in part on the determined one or more control commands such that the volumetric flow rate of moisture-laden air exiting the chamber through the drum exit is decreased and the relative humidity of moisture-laden air exiting the chamber through the drum exit is increased.

6. The dryer appliance of claim 2, wherein when the relative humidity of moisture-laden air exiting the chamber through the drum exit is within the predetermined operating range, the controller causes the blower fan to maintain a blower fan speed based at least in part on the determined one or more control commands.

7. The dryer appliance of claim 1, wherein the controller is configured to:

determine whether the dryer appliance is operating in a steady state condition, and wherein when the dryer appliance is operating in the steady state condition, the controller is configured to iteratively:

receive, from the sensor, an input indicative of the relative humidity of moisture-laden air exiting the chamber through the drum exit;

determine one or more control commands based at least in part on the received input indicative of the relative humidity of moisture-laden air exiting the chamber through the drum exit; and cause the blower fan to adjust a volumetric flow rate of moisture-laden air exiting the chamber through the drum exit based at least in part on the determined one or more control commands.

8. The dryer appliance of claim 1, wherein the controller is configured to:

cause, at a predetermined time with respect to an end of a drying cycle in which the dryer appliance is operating, a decrease in a blower fan speed of the blower fan such that a relative humidity of hot dry air entering the chamber through the drum inlet is decreased.

9. The dryer appliance of claim 8, wherein the controller causes, at the predetermined time with respect to the end of the drying cycle in which the dryer appliance is operating, the decrease in the blower fan speed of the blower fan to decrease at a predetermined interval.

10. The dryer appliance of claim 1, wherein the sensor is positioned along the duct system at or proximate the drum exit.

11. The dryer appliance of claim 1, wherein the conditioning system comprises a sealed system having a compressor, a condenser, an expansion device, and an evaporator in serial fluid communication.

12. A method of operating a dryer appliance, comprising:

receiving, by a controller of the dryer appliance, an input indicative of a relative humidity of moisture-laden air exiting a chamber defined by a drum of the dryer appliance;

determining, by the controller, one or more control commands based at least in part on the received input indicative of the relative humidity of moisture-laden air exiting the chamber of the drum, wherein the determining comprises determining, by the controller and based on the received input, whether the relative humidity of moisture-laden air exiting the chamber of the drum is greater than an upper limit of a predetermined operating range or less than a lower limit of the predetermined operating range; and causing a blower fan to adjust a volumetric flow rate of moisture-laden air exiting the chamber of the drum based at least in part on the determined one or more control commands, and wherein:

i) when the relative humidity of moisture-laden air exiting the chamber is greater than the upper limit of the predetermined operating range, the controller causes an increase in a blower fan speed of the blower fan based at least in part on the one or more control commands such that the volumetric flow rate of moisture-laden air exiting the chamber is increased and the relative humidity of moisture-laden air exiting the chamber is decreased, and ii) when the relative humidity of moisture-laden air exiting the chamber is less than the lower limit of the predetermined operating range, the controller causes a decrease in a blower fan speed of the blower fan based at least in part on the determined one or more control commands such that the volumetric flow rate of moisture-laden air exiting the chamber of the drum is decreased and the relative humidity of moisture-laden air exiting the chamber through the drum exit is increased.

13. The method of claim 12, wherein when the relative humidity of moisture-laden air exiting the chamber is within the predetermined operating range, the controller causes the blower fan to maintain a blower fan speed based at least in part on the determined one or more control commands.

14. A method of operating a dryer appliance, comprising:

receiving, by a controller of the dryer appliance, an input indicative of a relative humidity of moisture-laden air exiting a chamber defined by a drum of the dryer appliance;

determining, by the controller, one or more control commands based at least in part on the received input indicative of the relative humidity of moisture-laden air exiting the chamber of the drum;

causing a blower fan to adjust a volumetric flow rate of moisture-laden air exiting the chamber of the drum based at least in part on the determined one or more control commands; and causing, by the controller at a predetermined time with respect to an end of a drying cycle in which the dryer appliance is operating, a decrease in a blower fan speed of the blower fan such that a relative humidity of hot dry air entering the chamber is decreased.

15. The method of claim 14, wherein the controller causes, at the predetermined time with respect to the end of the drying cycle in which the dryer appliance is operating, the decrease in the blower fan speed of the blower fan to decrease at a predetermined interval.

* * * * *